US006068734A

United States Patent [19]

Wallenius et al.

[11] Patent Number: 6,068,734

[45] Date of Patent: May 30, 2000

[54] SOFT, BULKY ABSORBENT PAPER CONTAINING CHEMITHERMOMECHANICAL PULP

[75] Inventors: Hans Wallenius, Ljungskile; Bengt Nordqvist, Mölnlycke, both of Sweden

[73] Assignee: SCA Hygiene Paper AB, Goteborg, Sweden

[21] Appl. No.: 09/068,938

[22] PCT Filed: Nov. 21, 1996

[86] PCT No.: PCT/SE96/01516

§ 371 Date: May 21, 1998

§ 102(e) Date: May 21, 1998

[87] PCT Pub. No.: WO97/19198

PCT Pub. Date: May 29, 1997

[30] Foreign Application Priority Data

Nov. 24, 1995 [SE] Sweden ..... 9504209

[51] Int. Cl.[7] ..... D21H 11/10; D21H 11/02

[52] U.S. Cl. ..... 162/141; 162/149; 162/147; 162/142; 162/100

[58] Field of Search ..... 162/25, 26, 78, 162/83, 141, 142, 147, 9, 4, 100, 111, 149, 123, 125, 129, 130; 428/152, 153

[56] References Cited

U.S. PATENT DOCUMENTS

| | | | |
|---|---|---|---|
| 4,120,747 | 10/1978 | Sarge, III et al. | 162/117 |
| 4,776,926 | 10/1988 | Lindahl | 162/28 |
| 5,275,698 | 1/1994 | Dasgupta et al. | 162/177 |
| 5,607,546 | 3/1997 | Höglund et al. | 162/25 |
| 5,611,890 | 3/1997 | Vinson et al. | 162/111 |
| 5,879,510 | 3/1999 | Hagglund et al. | 162/25 |

FOREIGN PATENT DOCUMENTS

| | | |
|---|---|---|
| 0 478 045 B1 | 3/1995 | European Pat. Off. . |
| 1117731 | 6/1968 | United Kingdom . |
| 91/12367 | 8/1991 | WIPO . |

*Primary Examiner*—Stanley S. Silverman
*Assistant Examiner*—José A Fortun
*Attorney, Agent, or Firm*—Burns, Doane, Swecker & Mathis, L.L.P.

[57] ABSTRACT

Soft, bulky, absorbent paper containing at least 20 percent by weight of a high-temperature chemithermomechanical pulp (HT-CTMP), calculated on the total fibre weight. The paper also contains at least 10 percent by weight pulp that exhibits good strength properties, such as chemical pulp and/or recycled fibre pulp, and has a bulk of at least 5.5 $cm^3/g$. The bulk, absorption and liquid-dispersion properties of the paper are enhanced by admixing HT-CTMP with the paper pulp.

10 Claims, 2 Drawing Sheets

SOFT, BULKY ABSORBENT PAPER CONTAINING CHEMITHERMOMECHANICAL PULP

BACKGROUND OF THE INVENTION

The present invention relates to a soft, bulky absorbent paper. Soft paper or tissue paper, which is used in household paper products, toilet paper, serviettes, paper handkerchiefs, face tissues, etc., can be produced from a number of different types of pulp fibres. When disregarding recycled fibres, which at present are used to a large extent primarily in the manufacture of toilet paper and household paper, and considering solely the use of primary fibres, chemical pulp is the most usual type of pulp used in the manufacture of soft paper. Chemical pulp is produced by impregnating wood chips with chemicals and thereafter cooking the chips so that the lignin, resins and hernicellulose present pass into the liquor used. Upon completion of the cooking process, the pulp is screened and washed prior to being bleached, Such pulp contains practically no lignin and the fibres, which consist substantially of pure cellulose, are relatively slender and flexible. Chemical pulp may be comprised of either long fibres or short fibres, depending on the nature of the wood used, and may be either a sulphate pulp or a sulphite pulp, depending on the composition of the cooking liquor. Chemical long-fibre pulps, particularly sulphate pulps, have a favourable influence on the strength properties of soft paper with regard to both dry strength and wet strength.

Chemical pulp is a low yield pulp, since it gives a yield of only about 50% calculated on the wood starting material used. Chemical pulp is therefore a relatively expensive pulp. Consequently, less expensive so-called high-yield pulps have been used in soft paper, for instance mechanical or thermomechanical pulps; see GB Patent Specification 1,533,045 in this regard. Mechanical pulps are produced by grinding or refining the wood starting material. The principle applied in the manufacture of mechanical pulp is to break down the wood mechanically. All of the wood material is used and the lignin thus remains in the fibres, which are relatively short and stiff. Thermomechanical pulp (TMP) is produced by refining the wood in disc refiners at an elevated steam pressure. The lignin also remains in the fibres of thermomechanically produced pulp.

Chemithermomechanical pulp (CTMP) is the designation given to a thermomechanical pulp that has been modified by adding small quantities of chemicals, usually sulphite, which are added prior to the refining process. The admixture of a given amount of chemithermomechanical pulp in soft paper has positive effects on such properties as bulk and absorbency.

All of the aforementioned pulp types are at present used in the manufacture of soft paper.

OBJECTS OF THE INVENTION AND THE MOST IMPORTANT CHARACTERISTICS THEREOF

The object of the present invention is to provide a soft paper whose properties have been further enhanced with regard to bulk and absorbency. This object has been achieved by including in the paper at least 20 percent by weight, calculated on the total fibre weight, of high-temperature chemithermomechanical pulp (HT-CTMP) which exhibits the following properties:

a long-fibre content which lies between 60 and 75% (fibres that are retained on a wire having a mesh width of 30 mesh) when fractionating in accordance with Bauer McNett, a fine-material content of at most 14% (fibres that pass through a wire having a mesh width of 200 mesh) when fractionating in accordance with Bauer McNett, a freeness of at lowest 600 ml CSF, a shive content lower than 0.5%, preferably lower than 0.25%, and a tensile index of at least 10 kNm/kg, wherein the paper also includes at least 10 percent by weight of a pulp that has good strength propernes, such as chemical pulp and/or recycled fibre pulp.

It has surprisingly been found that an admixture of at least 20% HT-CTMP will give the paper a much greater bulk than will a corresponding amount of admixed conventional CTMP. The absorbency and liquid dispersion rate of the paper is also improved when admixing HT-CTMP with the paper pulp. The bulk, absorbency and liquid-dispersion properties of the paper are improved with increasing amounts of HT-CTMP admixed with the paper pulp.

An admixture of at least 10% chemical pulp, preferably long-fibre sulphate pulp, imparts requisite strength properties to the paper. Other pulps that have good strength properties may also be used to obtain the requisite paper strength, such as pulps that have been produced from recycled fibres. Other types of fibre may also be included, for instance mechanical pulp, thermomechanical pulp, CTMP, chemical short-fibre pulp, and so on.

The chemical pulp admixture in the paper has preferably been beaten to a drainage resistance of between 20–40° SR, more preferably to 22–30° SR, whereas the HT-CTMP pulp has not been beaten or has been beaten to a freeness of at the lowest 600 ml CSF.

The invention also relates to so-called multi-layer paper where at least one of the layers contains at least 20 percent by weight HT-CTMP and where the fibre composition of at least one other layer differs from the fibre composition of the first-mentioned layer.

BRIEF DESCRIPTION OF THE DRAWINGS

The invention will now be described in more detail with reference to the accompanying drawings, in which.

DESCRIPTION OF THE INVENTION

Figure 1:
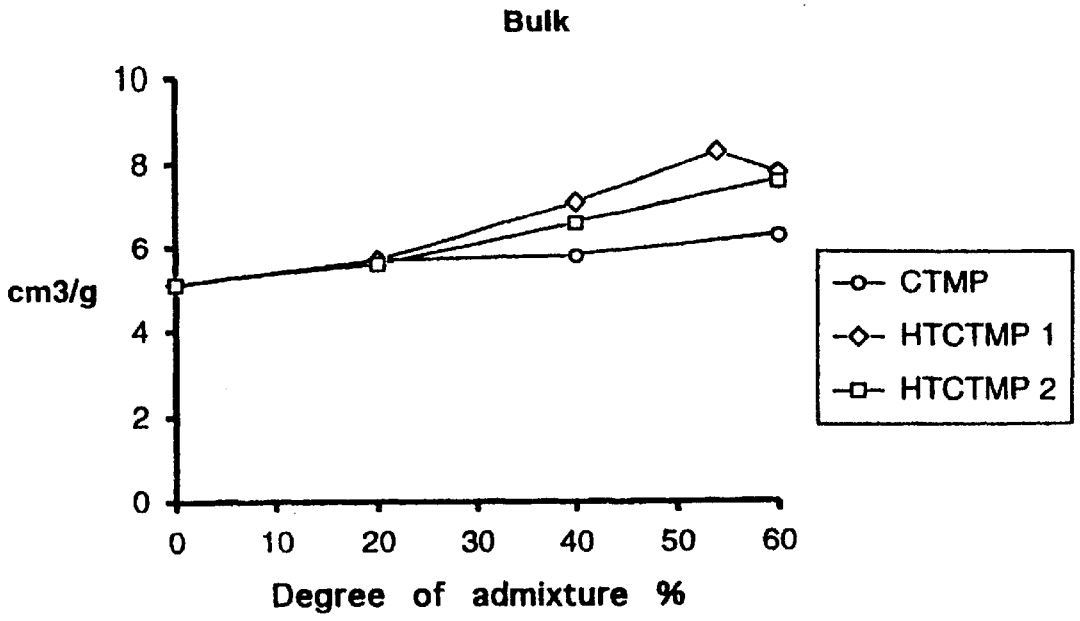
FIG. 1 illustrates bulk as a function of the degree to which CTMP and HT-CTMP are respectively admixed with the paper pulp, in two different qualities.

According to the invention, the paper shall contain at least 20 percent by weight, calculated on the total fibre weight, of high-temperature chemithermomechanical pulp of a given specified type, referred to in the following as HT-CTMP. This pulp and the method of its manufacture are described in Swedish Patent Application No. 9402 101-1, thee disclosures of which are considered to constitute part of the present document. A characteristic feature of this pulp is that it is a long-fibre, high drainability, bulky high-yield pulp having a low shive content and a low fine-material content.

It has a density lower than 400 kg/m$^3$, preferably lower than 325 kg/m$^3$, and more preferably lower than 275 kg/m$^3$. The yield is above 88% and the extract content beneath 0.15%. The pulp has good strength properties—tensile index above 10 kNm/kg, preferably above 15 kNm/kg and more preferably above 20 kNm/kg. The shive content is very low—lower than 0.5%, preferably lower than 0.25% and more preferably lower than 0.10%. The pulp has a low fine-material content—at most 14% according to BMN<200 mesh (Tyler Standard), preferably at most 10%. The long-fibre content is high—between 60 and 75% according to BMN>30 mesh, preferably between 62 and 72% and more preferably between 63 and 70%. The pulp has a high freeness value—at the lowest 600 ml CSF, preferably at the lowest 650 ml CSF and more preferably at the lowest 720 ml CSF.

The raw fibre material used in the manufacture of the pulp may be any lignocellulose-containing materials for instance wood or grass. Softwood, such as spruce, is an appropriate material in this regard.

The method applied in the manufacture of said pulp (HT-CTMP) differs from the standard method used to produce CTMP, primarily because a higher temperature is used in the impregnating, preheating and refining processes, preferably a temperature of at the lowest 140° C. Reference is made to the aforementioned Swedish Patent Application No. 9402101-1 for a more detailed description of the method of producing HT-CTMP pulp With the intention of establishing the extent to which HT-CTMP influences the properties of the paper in comparison with standard types of CTMP, there were carried out a number of tests in which different amounts of HT-CTMP and CTMP were admixed with the paper pulp. The remainder of the paper pulp used in all tests was a sulphate-type chemical long-fibre pulp. The HT-CTMP pulp and CTMP pulp were admixed in amounts corresponding to 20, 40, 54 and 60 percent by weight calculated on the total fibre weight. The CTMP used was obtained from Östrand and had a bulk density of about 2.7 $cm^3/g$, a freeness of 500 ml CSF, a shive content (Sommerville) of 0.1%, a tensile index of about 28 kNm/kg, a long-fibre content according to Bauer McNett (>30 mesh) of about 62% a short-fibre content according to Bauer McNett (<200 mesh) of about 15%, and a tear index of about 9.5 $m^2/kg$.

Two different HT-CTMP qualities were used, I and II, wherein I had a greater bulk. HT-CTMP I had a bulk of 4.25 $cm^3/g$, a freeness of 735 ml CSF, a shive content (Sommerville) of 0.36%, a tensile index of 14 kNm/kg, a long-fibre content according to Bauer McNett (>30 mesh) of 71%, a short-fibre content according to Bauer McNett (<200 mesh) of 9% and a tear index of 6 $m^2/kg$.

HT-CTMP II had a bulk of 3.0 $cm^3/g$, a freeness of 650 ml CSF, a shive content (Sommerville) of 0.1%, a tensile index of 22 kNm/kg, a long-fibre content according to Bauer McNett (>30 mesh) of 65.5%, a short-fibre content according to Bauer McNett (<200 mesh) of 9% and a tear index of 9 $m^2/kg$.

The reference paper used was a paper that had been produced from pure chemical long-fibre pulp of the sulphatc type, Munksjö TCF-80, which was beaten to a freeness of between about 20 and about 26° SR. The beating process was effected with a constant energy input calculated per tonne of produced paper, meaning that the chemical pulp was beaten, or refined, to a greater extent per kilogram at the lower degrees of admixture of the chemical pulp. All parameters were kept constant during the tests, with the exception of the amounts in which CTMP and HT-CTMP were admixed with the paper pulp. The amount of spray chemicals delivered in conjunction with crêping the paper was adjusted to obtain correct adhesion to the Yankee cylinder.

The tests were carred out by preparing fibre stock with a head-box consistency in the range of 0.1–0.3% based on the dry-fibre weight. A wet strength agent was also added to the fibre stock. The stock was delivered to the head box of a tissue paper machine and a paper web was formed on the wire. The formed paper web was drained, predried and transferred to a Yankee cylinder, where the web was further dried prior to being crêped on the cylinder with the aid of a doctor blade.

The person skilled in this art will know that tissue paper can be produced on various types of paper machines and that crêping of the paper to impart desired softness thereto can be replaced with techniques such as through-air drying. It will be understood that all of the processes by means of which tissue paper can be manufactured in accordance with the invention are included in the present Application document.

Prior to crêping, the dry formed paper web will conveniently have a weight per unit area of 12–30 $g/m^2$, and after creping a weight per unit area of 16–45 $d/m^2$.

The qualities of the paper produced with regard to weight per unit area, thickness, bulk, dry and wet strength, absorption and liquid dispersion rate were measured and the values obtained have been set forth in Tables 1–3 below. The qualities were measured by standard SCAN or SIS methods, which are stated in the following Tables. The measurement values given in the Tables are the mean values of the values obtained measuring three different samples.

Table 1 shows weight per unit area, thickness and bulk of the produced paper with different amounts of CTMP and the two different HT-CTMP qualities admixed with the paper pulp. Paper produced from pure chemical pulp is used as a reference.

TABLE 1

| Pulp | Admix degree | Weight per unit area ($g/m^2$) | Thickness ($\mu m$) | Bulk ($cm^3/g$) |
|---|---|---|---|---|
| Ref. | | 29.4 | 148 | 5.1 |
| CTMP | 20% | 29.4 | 166 | 5.7 |
| " | 40% | 29.2 | 169 | 5.8 |
| " | 60% | 29.4 | 183 | 6.3 |
| HTCTMP 1 | 20% | 29.6 | 168 | 5.7 |
| " | 40% | 29.7 | 208 | 7.1 |
| " | 54% | 30.0 | 248 | 8.3 |
| " | 60% | 29.0 | 227 | 7.8 |
| HTCTMP 2 | 20% | 30.2 | 168 | 5.6 |
| " | 40% | 29.9 | 198 | 6.6 |
| " | 60% | 29.4 | 224 | 7.6 |
| Method | | SCAN-P6:75 | SCAN-P47:83 | Calc. |

FIG. 1 shows bulk as a function of the degree of admixture of CTMP and HT-CTMP I and II respectively. As will be seen from the Figure, the bulk of those papers that contain HT-CTMP increase markedly in comparison with the paper containing standard CTMP at admixture degrees of about 20% and higher. The greatest bulk increase was obtained with HT-CTMP I.

Table 2 shows the dry strength and wet strength of the produced paper with different degrees of admixture of CTP and the two different HT-CTMP qualities. Paper produced from pure chemical pulp is used as a reference.

TABLE 2

| Pulp | Admix degree | Dry strength MD N/m | Dry strength CD N/m | MD/CD ratio | Wet strength MD N/m | Wet strength CD N/m |
|---|---|---|---|---|---|---|
| Ref. | | 333 | 216 | 1.5 | 78 | 53 |
| CTMP | 20% | 351 | 235 | 1.5 | 102 | 61 |
| " | 40% | 368 | 228 | 1.7 | 89 | 60 |
| " | 60% | 378 | 229 | 1.7 | 106 | 63 |
| HTCTMP 1 | 20% | 349 | 220 | 1.6 | 99 | 56 |
| " | 40% | 329 | 190 | 1.8 | 85 | 52 |
| " | 54% | 303 | 173 | 1.8 | 92 | 49 |
| HTCTMP 2 | 20% | 355 | 235 | 1.5 | 91 | 56 |
| " | 40% | 369 | 210 | 1.8 | 100 | 59 |
| " | 60% | 307 | 185 | 1.7 | 89 | 54 |
| Method | | SCAN-P44:81 | SCAN-P44:81 | Calc. | SCAN-P58:86 | SCAN-P58:86 |

Table 3 shows absorption and liquid-dispersion properties (WAT) in the length(x)-, cross(y)- and thickness(z)-directions of the produced paper with different degrees of admixture of CTMP and the two different HT-CTMP qualities. Paper produced from pure chemical pulp is used as a reference.

TABLE 3

| Pulp | Admix degree | Total abs. water g/g | WAT, x s/cm | WAT, y s/cm | WAT, z s/cm |
|---|---|---|---|---|---|
| Ref. | | 3.8 | 3.91 | 0.93 | 0.59 |
| CTMP | 20% | 3.9 | 4.08 | 0.86 | 0.70 |
| " | 40% | 4.1 | 4.15 | 0.85 | 0.83 |
| " | 60% | 4.3 | 4.30 | 0.76 | 0.85 |
| HTCTMP 1 | 20% | 3.9 | 3.35 | 0.77 | 0.53 |
| " | 40% | 4.7 | 2.35 | 0.53 | 0.38 |
| " | 54% | 4.9 | 1.94 | 0.4 | 0.38 |
| " | 60% | 5.0 | 1.89 | 0.61 | 0.45 |
| HTCTMP 2 | 20% | 3.9 | 4.37 | 0.86 | 0.47 |
| " | 40% | 4.4 | 2.92 | 0.64 | 0.50 |
| " | 60% | 4.6 | 2.38 | 0.60 | 0.59 |
| Method | | SIS-251228 | SCAN-P62:88 | SCAN-P62:88 | SCAN-P62:88 |

Figure 2:
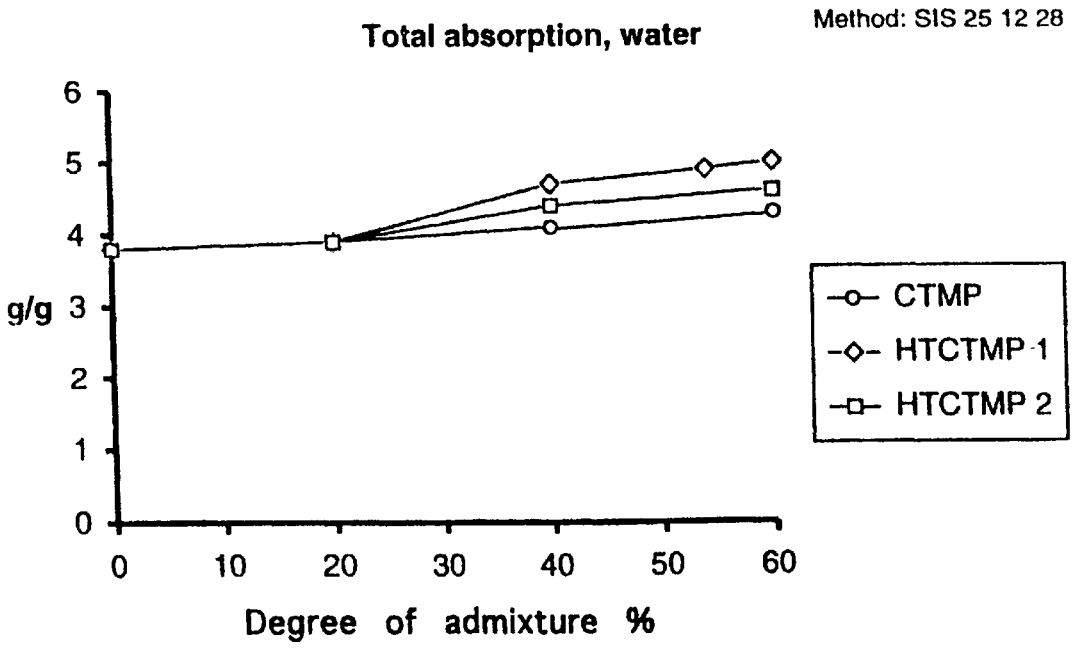
FIG. 2 illustrates absorbency as a function of the degree of admixture of CTMP and HT-CTMP respectively, in two different qualities.

FIG. 2 shows the absorbency of the paper as a function of the degree of admixture of CTMP and HT-CTMP I and II respectively. The absorbency of the paper that contained HT-CTMP increased more with increasing degrees of admixture in comparison with the paper that contained standard CTMP. The paper that contained HT-CTMP I exhibited the greatest absorbency.

Figure 3A:
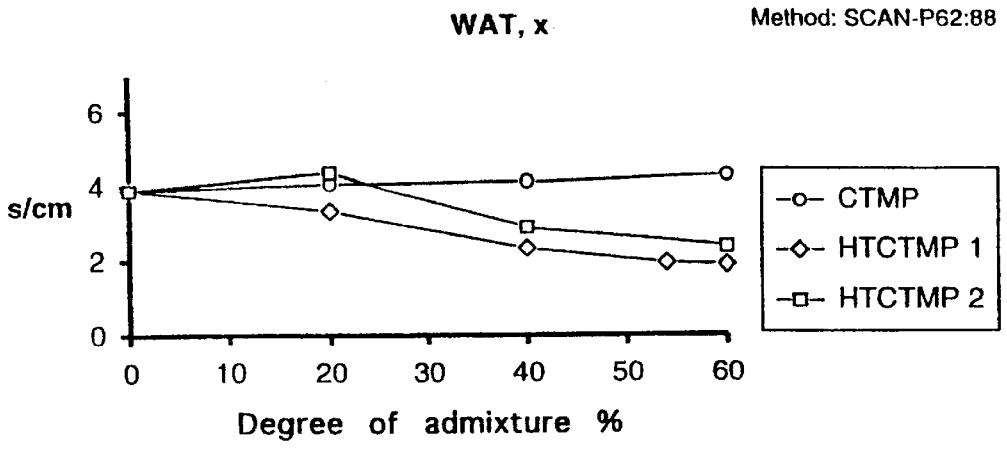
FIGS. 3*a–c* illustrates the dispersion rate in the length, cross and thickness directions of the paper as a function of the degree of admixture of CTM and HT-CTMP respectively, in two different qualities.
Figure 3B:
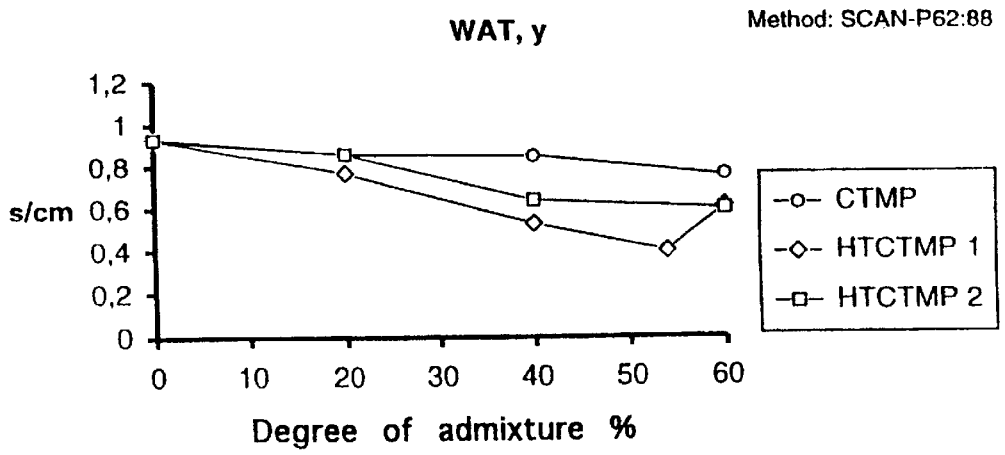
Figure 3C:
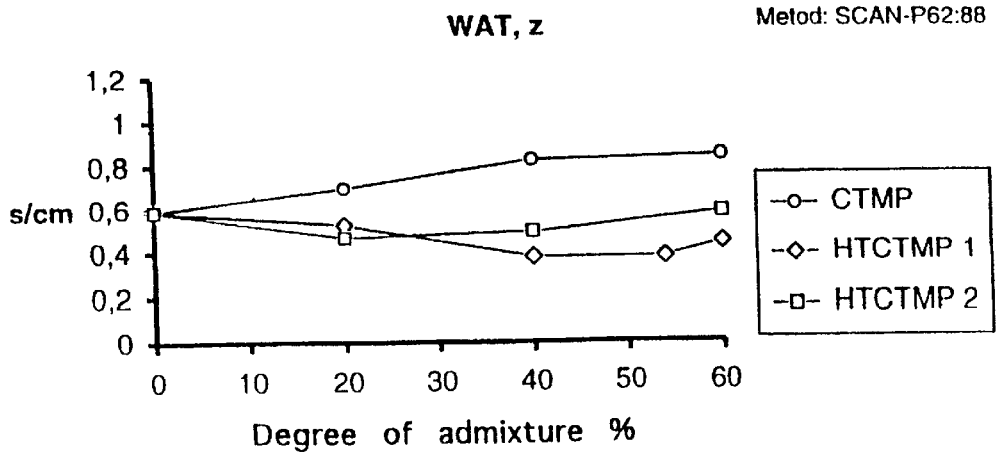

FIGS. 3*a–c* illustrate the dispersion rate in the length-, cross- and thickness-directions of the paper as a function of the degree of admixture of CTMP and HT-CTMP I and II respectively. It will be seen from the Figures that the dispersion rate in the length-direction of the paper (the x-direction) increased with increasing degrees of admixture of HT-CTMP, particularly HT-CTMP I, whereas the dispersion rate decreased with increasing degrees of admixture of CTMP. The dispersion rate increased in the cross direction (the y-direction) with increasing degrees of admixture of both CTMP and HT-CTMP, although more with HT-CTMP and most with HT-CTMP I. The dispersion rate in the thickness direction (the z-direction) fell with increasing degrees of admixture of CTMP. It was generally constant for HT-CTMP II and increased markedly for HT-CTMP I. A high dispersion rate means better and quicker use of the total absorption capacity of the paper and is thus an important function.

It can be said in summary that an admixture of at least 20, and preferably at least 25 percent by weight, HT-CTMP in tissue paper will result in a surprisingly high quality increase with regard to such important properties as bulk, absorbency and liquid-dispersion ability. However, similar to CTMP, the wet and dry strengths of the paper are lowered with increasing degrees of admixture of HT-CTMP. In order to achieve acceptable strength levels, it is recommended that the paper contains at least 10 percent by weight, preferably at least 20 percent by weight, of pulp that has good strength qualities, such as chemical pulp or recycled fibre pulp. The chemical pulp is preferably a sulphate-type softwood pulp. Other types of fibre may also be included, such as mechanical pulp, thermomechanical pulp, CTMP, chemical short-fibre pulp, and so on. It should also be mentioned that a soft paper containing more than 90% and even up to 100% HT-CTMP can be produced when a low-strength paper can be accepted.

The chemical pulp included in the paper is preferably beaten to a drainage resistance of between 20–45° SR, preferably between 22–30° SR, whereas the HT-CTMP pulp is unbeaten or beaten to a freeness of at the lowest 600 ml CSF. If the two pulps, i.e. the chemical pulp and the HT-CTMP, are beaten together to essentially the same drainage resistance, a large part of the bulk improving and absorption-improving properties of the HT-CTMP will be lost in the main.

It is known in the manufacture of tissue paper to use a multi-layer box and to lay different types of pulps in different layers. In view of the good absorbency and liquid-dispersion ability of HT-CTMP, HT-CTMP may be laid in the centre layer or in the outermost of said different layers, depending on the properties primarily desired of the paper.

When a high total absorption capacity is desired, HT-CTMP, optionally mixed with another pulp, such as chemical pulp, will preferably form the centre layer, whereas the outer layers will comprise pulp that has good strength properties, such as chemical pulp and/or recycled fibre pulp, preferably in an amount corresponding to at least 81 percent by weight and more preferably 85 percent by weight. HT-CTMP is included in the centre layer preferably in an amount corresponding to at least 20 percent by weight.

When desiring primarily a paper which exhibits quick absorption properties, HT-CTMP, optionally admixed with chemical pulp and/or recycled fibre pulp for instance, is conveniently placed in the outermost layers, while a centre layer of preferably at least 81 percent by weight and more preferably at least 85 percent by weigh chemical pulp and/or recycled fibre pulp will provide the strength required. HT-CTMP is preferably present in the outer layers in an amount corresponding to at least 20 percent by weight.

Multi-layer paper can also be formed with mixtures of other types of pulp, such as mechanical pulp, thermomechanical pulp, CTMP, chemical short-fibre pulp, and so on.

We claim:

1. Soft, bulky, absorbent paper comprising at least 20 percent by weight of high-temperature chemithermomechanical pulp (HT-CTMP), calculated on the total fibre weight, which exhibits the following properties:

a long-fibre content which when fractionating in accordance with Bauer McNett lies between 60% and 75%, fibres retained on a wire having a mesh width of 30 mesh, a fine-material content of at most 14% when fractionating in accordance with Bauer McNett, fibres pass through a wire having a mesh width of 200 mesh, a freeness of 600 ml CSF at the lowest, a shive content lower than 0.5%, and a tensile index of at least 10 kNm/kg;

and at least 10 percent by weight of a chemical pulp and/or recycled fibre pulp.

2. Paper according to claim 1, and having a bulk of at least 5.5 $cm^3/g$.

3. Paper according to claim 1, comprising up to 55 percent by weight recycled fibres.

4. Paper according to claim 1, comprising a sulphate pulp, as said chemical pulp, said sulphate pulp made from softwood.

5. Paper according to claim 1, wherein the shive content is lower than 0.25%.

6. Paper according to claim 1, comprising chemical pulp which has been beaten to a drainage resistance of at least 20° SR, the HT-CTMP included in the paper being either unbeaten or beaten to a freeness of 600 ml CSF at the lowest.

7. Paper according to claim 6, comprising chemical pulp which has been beaten to a drainage resistance of at least 22° SR.

8. Paper according to claim 1, which is a multi-layer paper where a first layer contains at least 20 percent by weight HT-CTMP and where a second layer has a fibre composition which differs from the fibre composition of the first layer.

9. Paper according to claim 8, wherein the second layer comprises at least 81% of said chemical pulp and/or recycled fibre pulp.

10. Paper according to claim 9, wherein the second layer comprises at least 85% of a chemical pulp.

* * * * *